US010892071B1

(12) United States Patent
Chiu et al.

(10) Patent No.: US 10,892,071 B1
(45) Date of Patent: Jan. 12, 2021

(54) THIN FILM RESISTOR ELEMENT

(71) Applicant: VIKING TECH CORPORATION, Hsinchu County (TW)

(72) Inventors: Cheng-Chung Chiu, Hsinchu County (TW); Chi-Yu Lu, Hsinchu County (TW)

(73) Assignee: VIKING TECH CORPORATION, Hsinchu County (TW)

( * ) Notice: Subject to any disclaimer, the term of this patent is extended or adjusted under 35 U.S.C. 154(b) by 0 days.

(21) Appl. No.: 16/810,231

(22) Filed: Mar. 5, 2020

(30) Foreign Application Priority Data

Dec. 18, 2019 (TW) ..... 108146445 A

(51) Int. Cl.
*H01C 7/00* (2006.01)
*H01C 17/075* (2006.01)
*H01C 1/142* (2006.01)

(52) U.S. Cl.
CPC ..... *H01C 7/006* (2013.01); *H01C 1/142* (2013.01); *H01C 17/075* (2013.01)

(58) Field of Classification Search
CPC ..... H01C 7/006; H01C 1/142; H01C 17/075
See application file for complete search history.

(56) References Cited

U.S. PATENT DOCUMENTS 4,019,168 A * 4/1977 Collins ..... H01C 7/006 338/309
4,025,404 A * 5/1977 Joly ..... H01L 21/4846 205/50
H498 H * 7/1988 Keller et al. ..... H01L 27/1255 174/94 R
2006/0181388 A1* 8/2006 Chinthakindi ..... H01L 27/0629 338/309
2010/0001273 A1* 1/2010 Kitakado ..... H01L 27/1255 257/57
2011/0169517 A1* 7/2011 Kim ..... G01R 3/00 324/756.03

* cited by examiner

*Primary Examiner* — Kyung S Lee
(74) *Attorney, Agent, or Firm* — Muncy, Geissler, Olds & Lowe, P.C.

(57) ABSTRACT

A thin film resistor element is provided with a tantalum nitride (TaN) layer on an upper surface of a substrate, a tantalum pentoxide ($Ta_2O_5$) layer disposed on the tantalum nitride layer, and two electrode layers separately disposed on the tantalum pentoxide layer or on both ends of the tantalum nitride layer and the tantalum pentoxide layer. The thin film resistor element of the present invention can reduce the oxidation rate of the resistor layer to maintain a constant resistance value at high temperatures generated during use.

5 Claims, 2 Drawing Sheets

THIN FILM RESISTOR ELEMENT

BACKGROUND OF THE INVENTION

1. Field of the Invention

The present invention relates to a thin film resistor element, particularly to a thin film resistor element with high temperature resistance.

2. Description of the Prior Art

A thin film resistor element could be damaged under a high temperature, because its resistor layer is oxidized.

Today, the electronic devices keep operating to generate heat and that damages the resistor element. Except for using the heat dissipation elements, the thin-film resistor element should be able to resist to high temperature. The invention proposes a solution to provide a thin-film resistor element with a high-temperature resistance.

SUMMARY OF THE INVENTION

The present invention provides a thin-film resistor element that can operate under a high temperature.

A thin film resistor element comprises a tantalum nitride (TaN) layer disposed on an upper surface of a substrate, a tantalum pentoxide ($Ta_2O_5$) layer disposed on the TaN layer to substantially cover the TaN layer, and an electrode layer separately disposed at two ends to form two electrodes, wherein the electrode layer is on the TaN layer or on the $Ta_2O_5$ layer and electrically connects to both layers.

Below, the embodiments, accompanied with the attached drawings, are employed to explain the objectives, technical contents, characteristics and accomplishments of the present invention.

DESCRIPTION OF THE PREFERRED EMBODIMENTS

Below, the embodiments accompanied with drawings are used to explain the present invention in detail for exemplify the present invention but not to limit the scope of the present invention. These embodiments also applies to other embodiments and vice versa. Any modification, variation, or substitution according to the spirit of the present invention should also be included within the scope of the patent, which is defined by the claims.

Figure 1:
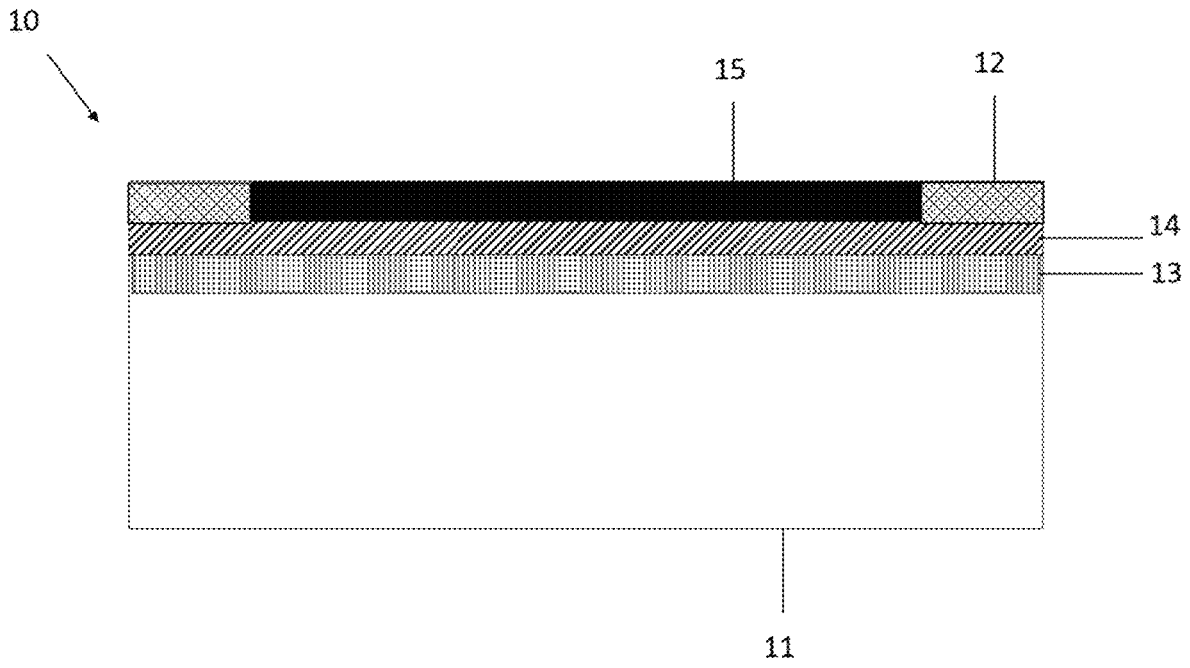
FIG. 1 is a schematic side sectional view of a thin film resistor element according to an embodiment of the present invention.

FIG. 1 is a schematic side sectional view of a thin film resistor element according to an embodiment of the present invention. The thin film resistor comprises a substrate 11, a TaN layer 13 on the substrate as a resistor layer, a $Ta_2O_5$ layer 14 on TaN layer 13 as a transition metal layer, and an electrode layer 12 at both sides of the thin film resistor to form two electrodes.

The TaN layer 13 substantially covers the upper surface of the substrate 11 and the $Ta_2O_5$ layer 14 substantially covers the TaN layer. The TaN layer 13 and the $Ta_2O_5$ layer 14 could be formed by bonding, sputtering, plating, evaporation, or printing and it is noted that they are made in the same reaction chamber. The thickness of the $Ta_2O_5$ layer 14 is about 50-200 nanometers (nm).

Both electrodes, formed by the electrode layer 12, are separately connected to both ends of the TaN layer 13 and the $Ta_2O_5$ layer 14. The electrode layer 12 are disposed on the $Ta_2O_5$ layer 14 in this embodiment shown in FIG. 1. In another embodiment shown as FIG. 3, the electrode layer is disposed at both ends of the TaN layer 13 and the $Ta_2O_5$ layer 14 without overlapping. The two electrodes, formed by the electrode layer 12, can cover, partially cover, or contact without overlapping the $Ta_2O_5$ layer 14 and the TaN layer 13. In the above embodiment, both electrodes electrically connect with the $Ta_2O_5$ layer 14 and the TaN layer 13.

Figure 2:
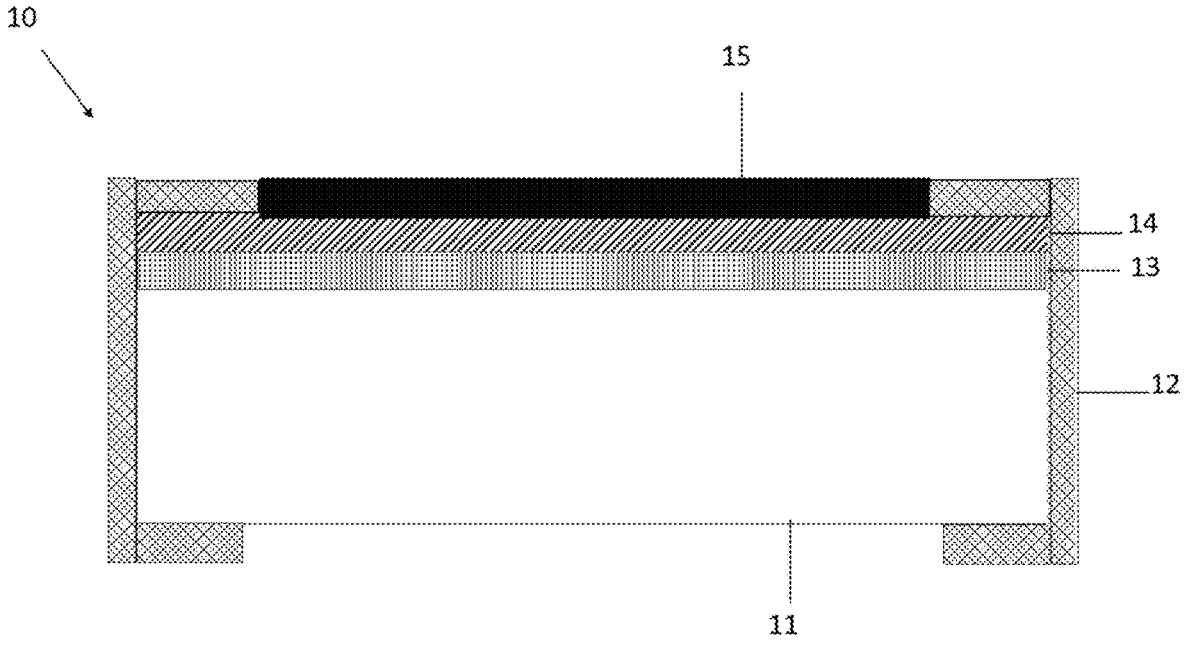
FIG. 2 is a schematic side sectional view of a thin film resistor element according to another embodiment of the present invention.
Figure 3:
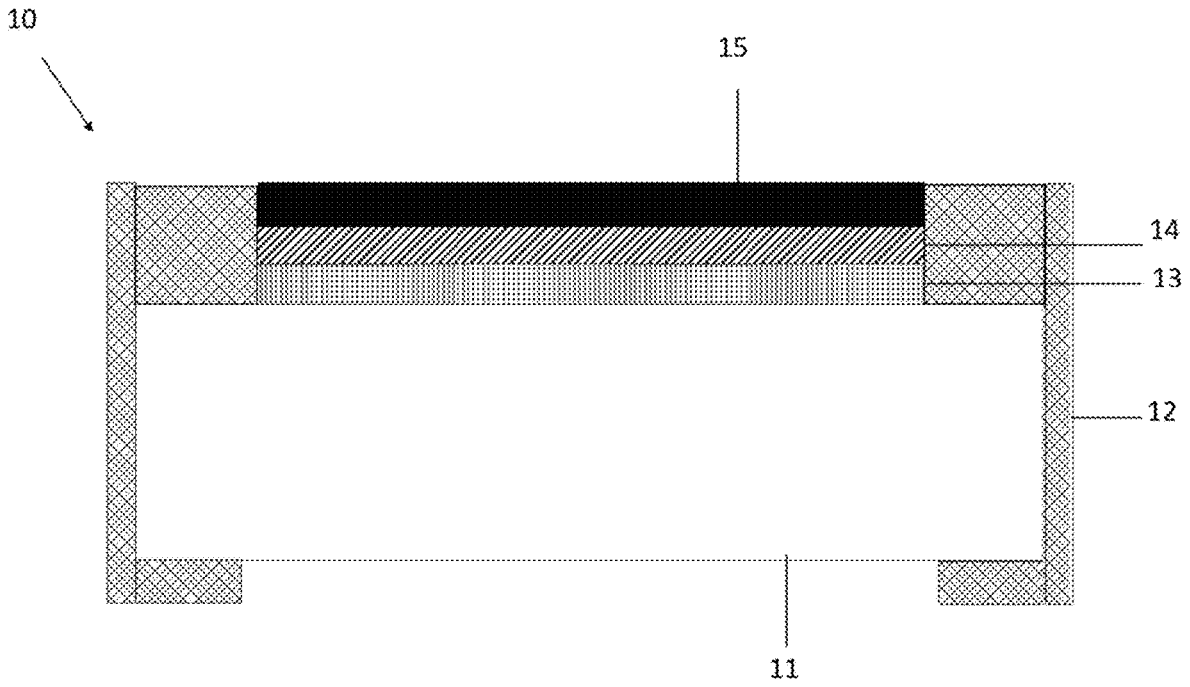
FIG. 3 is a schematic side sectional view of a thin film resistor element according to another embodiment of the present invention.

The embodiment shown in FIG. 2 and FIG. 3 uses the similar element number for the corresponding component of the embodiment shown above. Each of both electrodes extends along the side of the substrate 11 to a lower surface of the substrate 11.

The substrate 11 may be a ceramic substrate or other type of substrate. The substrate, in general, has a good property of heat dissipation, such as alumina, aluminum nitride, or other oxidized metal materials and so on. The substrate 11 is rectangular generally, but also could be made to other shapes.

A protection layer 15 could be formed on the $Ta_2O_5$ layer 14 but both electrodes are exposed from the protection layer.

In a high-temperature storage test, the temperature is set at 155° C. and the testing period is 1000 hours. With comparison to a conventional thin film resistor element, the thin film resistor element of the present invention has a smaller resistance variation, less than 0.1% in testing. The thin film resistor element of this invention has a stable resistance, because the $Ta_2O_5$ layer can be as a barrier layer to protect the TaN layer to be oxidized.

TABLE 1

| Standard change ratio of resistance (ΔR): 155° C./1,000 hr | |
|---|---|
| conventional thin film resistor element | >0.5% |
| Thin film resistor element of the present invention | <0.06% |

In summary, a $Ta_2O_5$ layer formed on the TaN layer prevent the TaN oxidation in the thin film resistance element of the present invention. Therefore, the thin film resistor element still has a stable resistance under high temperature.

What is claimed is:

1. A thin film resistor element, comprising:

a substrate;

a TaN layer disposed on an upper surface of the substrate;

a $Ta_2O_5$ layer disposed on the TaN layer, wherein a thickness of the $Ta_2O_5$ layer ranges from 50 to 200 nanometers (nm); and two electrodes made by an electrode layer separately disposed at both ends of the thin film resistor element, wherein the electrode layer is electrically connected to the TaN layer and the $Ta_2O_5$ layer.

2. The thin film resistor element according to claim 1, further comprising a protective layer, wherein the protection layer is disposed on the $Ta_2O_5$ layer but exposes the electrode layer.

3. The thin film resistor element according to claim 1, wherein each of the two electrodes extends along the side of the substrate to a lower surface of the substrate.

4. The thin film resistor element according to claim 1, wherein the electrode layer covers, partially covers or contacts without overlapping the TaN layer and the $Ta_2O_5$ layer.

5. The thin film resistor element according to claim 1, wherein the TaN layer and the $Ta_2O_5$ layer are formed by a bonding, sputtering or printing process.

* * * * *